US009827164B2

(12) United States Patent
Lizari Illarramendi et al.

(10) Patent No.: US 9,827,164 B2
(45) Date of Patent: Nov. 28, 2017

(54) MACHINE FOR PREPARING SUBSTANCES FOR INTRAVENOUS APPLICATION

(71) Applicant: KIRO ROBOTICS, S.L., Arrasate (Gipuzkoa) (ES)

(72) Inventors: Borja Lizari Illarramendi, Araico (ES); Naiara Telleria Garay, Arrasate-Mondragon (ES); Ana Belen Barrio Jimenez, Vitoria-Gasteiz (ES); Ainara Fol Ruiz De Loizaga, Vitoria-Gasteiz (ES)

(73) Assignee: KIRO GRIFOLS, S.L., Arrasate (Gipuzkoa) (ES)

( * ) Notice: Subject to any disclaimer, the term of this patent is extended or adjusted under 35 U.S.C. 154(b) by 119 days.

(21) Appl. No.: 14/716,352

(22) Filed: May 19, 2015

(65) Prior Publication Data

US 2015/0335532 A1 Nov. 26, 2015
US 2017/0202746 A9 Jul. 20, 2017

(51) Int. Cl.

| | |
|---|---|
| ***A61J 1/05*** | (2006.01) |
| ***B65B 3/04*** | (2006.01) |
| ***A61J 3/00*** | (2006.01) |
| ***B65B 3/00*** | (2006.01) |
| ***B65B 43/59*** | (2006.01) |

(52) U.S. Cl.
CPC ..... *A61J 3/002* (2013.01); *B65B 3/003* (2013.01); *B65B 43/59* (2013.01)

(58) Field of Classification Search
CPC ..... A61J 3/002; B65B 3/003; B65B 39/12; B65B 43/59; B65B 2039/009
USPC ..... 141/9, 18, 21, 114, 234, 237, 242
See application file for complete search history.

(56) References Cited

U.S. PATENT DOCUMENTS 3,683,977 A * 8/1972 Crowe ..... G01N 1/18 141/130
4,135,561 A * 1/1979 Senelonge ..... G01N 35/1065 141/234
4,294,802 A 10/1981 Johansson
(Continued)

FOREIGN PATENT DOCUMENTS

EP 1704844 A1 9/2006
EP 2457550 A1 5/2012
(Continued)

OTHER PUBLICATIONS

Search Report dated Aug. 7, 2015 in corresponding Spanish Application No. 201430745.
(Continued)

*Primary Examiner* — Nicolas A Arnett
(74) *Attorney, Agent, or Firm* — Knobbe Martens Olson & Bear LLP

(57) ABSTRACT

A machine for preparing substances for intravenous application includes: an initial container reception zone, a final container reception zone and a substance transfer circuit which includes a set of substance extraction devices, each of which is connected to a flexible tube connected to a device for introducing a substance into the final container by means of a peristaltic pump. The initial container reception zone and the vector of extraction devices are capable of relative movement along a horizontal axis and/or the final container reception zone and the vector of introduction devices are capable of relative movement along a horizontal axis.

9 Claims, 10 Drawing Sheets

(56) References Cited

U.S. PATENT DOCUMENTS

| | | | | |
|---|---|---|---|---|
| 4,952,518 | A | 8/1990 | Johnson et al. | |
| 5,785,098 | A * | 7/1998 | Sern | B65B 3/12 141/18 |
| 5,976,470 | A * | 11/1999 | Maiefski | B01J 19/0046 222/485 |
| 8,007,741 | B1 * | 8/2011 | Heyes | G01N 35/0099 422/500 |
| 2004/0094229 | A1 * | 5/2004 | Danby | A21B 7/00 141/114 |
| 2004/0141886 | A1 | 7/2004 | Py et al. | |
| 2006/0000470 | A1 | 1/2006 | Clarke et al. | |
| 2008/0169044 | A1 | 7/2008 | Osborne et al. | |
| 2013/0283733 | A1 | 10/2013 | Py | |

FOREIGN PATENT DOCUMENTS

| | | | |
|---|---|---|---|
| ES | 2138089 | T3 | 1/2000 |
| ES | 2447315 | A1 | 3/2014 |

OTHER PUBLICATIONS

Extended European Search Report dated Oct. 16, 2015 in Application No. 15382251.5.

* cited by examiner

MACHINE FOR PREPARING SUBSTANCES FOR INTRAVENOUS APPLICATION

CROSS-REFERENCE TO RELATED APPLICATION

This application claims priority to Spanish Patent Application No. 201430745 filed on May 21, 2014, the disclosure of which including the specification, the drawings, and the claims is hereby incorporated by reference in its entirety.

The present invention relates to a machine for preparing substances for intravenous application.

Machines for preparing substances for intravenous application are normally used in hospitals to produce mixtures of intravenous substances for application to each particular patient in order to reconstitute said substance from powder and/or for transferring a substance from an initial container, such as a vial, for example, to the final container, such as a bag, for example, from which it is applied to the patient by means of a line, or alternatively a syringe or another vial.

So far, the known machines for preparing mixtures for intravenous application have the drawbacks of being machines that are large, somewhat un-ergonomic and with a preparation capacity/speed that is not sufficiently satisfactory. Examples are also known that are small, but have very low productivity.

For example, U.S. Pat. No. 597,951 discloses a system for reconstituting a powdered medication and transferring this reconstituted medication to a syringe. However, the mechanism described by said patent relates to a system comprising a removable device for connection to a syringe which can be replaced by a device for connection to a vial. Consequently, the medication must be reconstituted (that is, the adjuvant added for an intravenous application), the connection device to the vial disconnected, a new connection device to a syringe fitted and the medication transferred to said syringe.

PCT patent WO2005096776 discloses a system for automatically filling IV type bags or syringes. This device is designed to fill multiple syringes automatically. The system described in this document discloses a rotary plate system for the arrangement of syringes but does not disclose how said syringes are filled.

PCT patent WO9009776 discloses a system for automatically filling IV type bags or syringes with a medication which, in addition, must be reconstituted. The device disclosed in said document comprises, separately, a reconstitution processing station and a filling station, and the vials are moved between said stations by means of a robotic arm.

An object of the present invention is to disclose a machine with improved capacity and speed of preparation compared with what is known at present.

Another object of the present invention is to disclose a machine for preparing mixtures for intravenous application, the characteristics of which allow said machine to be small enough to be included in a laminar flow cabin.

More particularly, the present invention discloses a machine for preparing substances for intravenous application which comprises:

an initial container reception zone, which defines a matrix of individual initial container reception zones, with the individual initial containers arranged along two horizontal axes which are perpendicular to each other, a final container reception zone, which defines a matrix of individual initial container reception zones, with the individual initial containers arranged along two horizontal axes which are perpendicular to each other, a substance transfer circuit which comprises a set of devices for extracting a substance from an individual initial container, said extraction devices being in a linear arrangement, so as to form a vector of extraction devices parallel to one of said axes of the matrix of individual initial container reception zones, each one being connected to a flexible tube connected to a device for introducing a substance into the final container, by means of a pump, preferably a peristaltic pump, the substance introduction devices also being in a linear arrangement to each other, so as to form a vector of introduction devices parallel to one of said axes of the matrix in which the final container reception zone is arranged, and in which the initial container reception zone or the vector of extraction devices or both are capable of relative movement along a horizontal axis perpendicular to the vector of extraction devices, and/or the final container reception zone and the vector of introduction devices are capable of relative movement along a horizontal axis perpendicular to the vector of introduction devices.

Preferably, the initial container reception zone and the vector of extraction devices have said ability to move relative to one another and in addition the final container reception zone and the vector of introduction devices also have said ability to move relative to one another.

Finally, the device according to the present invention has the initial containers and the final containers arranged in a matrix and has the devices responsible for the extraction and introduction of the substances from and into said containers arranged in a linear vector. This allows the loading and unloading of batches using short linear movements between batches and without using circular movements, which allows great speed of movement and a smaller size, as the length of the movements is minimised.

In addition, and particularly advantageously, the introduction devices and the extraction devices will have the ability to move vertically, so that they can connect to/disconnect from the respective containers. Even more preferably, each of the introduction or extraction devices will have the ability to move vertically independently of the rest of the devices in its vector.

Preferably, the introduction and/or extraction devices will have addition points.

In preferred embodiments, the introduction devices and/or extraction devices will comprise syringes.

To understand the invention more fully, the accompanying drawings show an embodiment of the medication transfer device of the present invention as an explanatory and non-limiting example.

Figure 1:
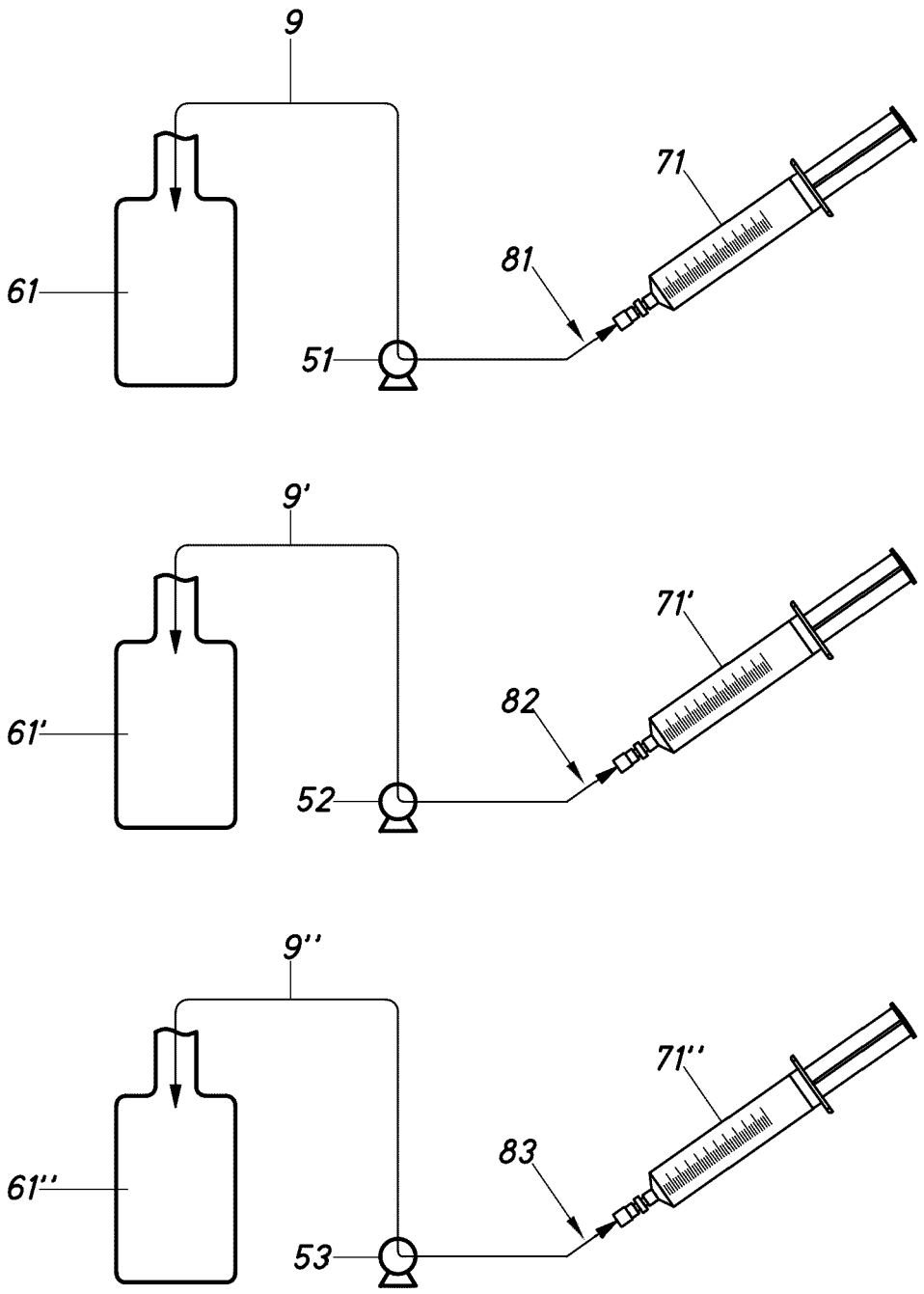
FIG. 1 is a diagram of the transfer system from initial containers to final containers of an example of a machine according to the present invention.

FIG. 1 is a diagram of the transfer system from initial containers to final containers in an example of the machine according to the present invention. Shown in the figure is a set of initial containers 61, 61', 61", a set of final containers 71, 71', 71" (syringes, in this case) in which a substance is transferred from each initial container to each final container by means of three transfer circuits which each comprise a flexible tube 9, 9', 9" (made of silicone, for example) and a pump 51, 51', 51", which in this case is a peristaltic pump. Addition points 81, 82, 83 have been arranged in the zone where the substance is introduced into the final containers 71, 71', 71".

Figure 2:
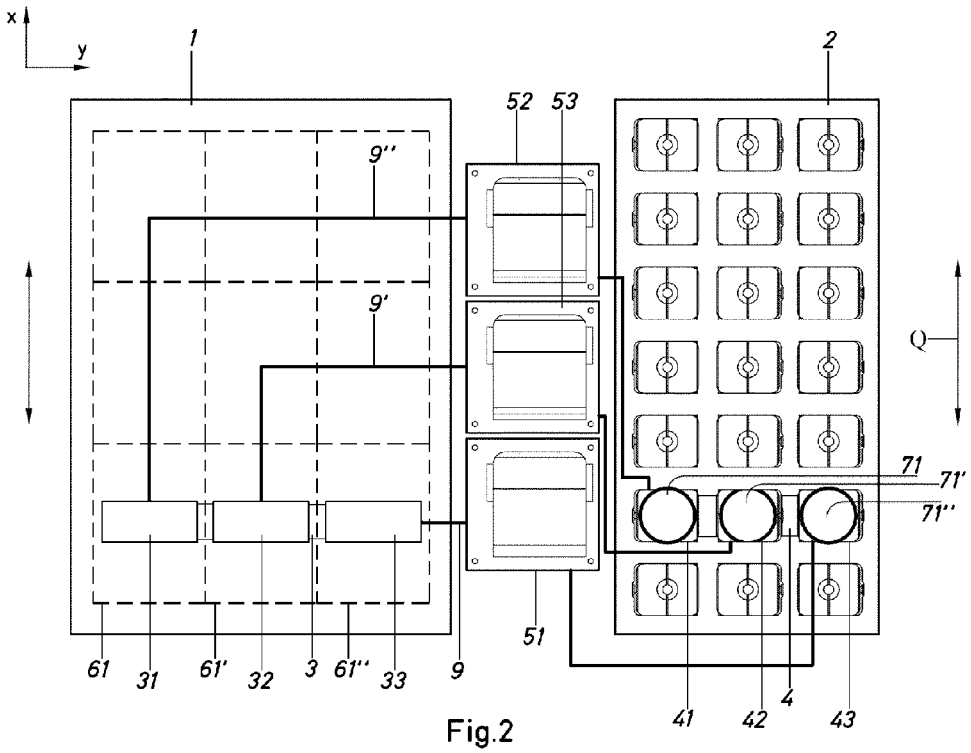
FIG. 2 shows diagrammatically an example of a machine according to the present invention.

FIG. 2 shows diagrammatically a machine according to the present invention. An initial container reception zone 1 can be seen in the figure, which zone defines a matrix of individual reception zones for initial containers which each receive an individual initial container 61, 61', 61". In accordance with the defined matrix, the individual initial containers 61, 61', 61" are arranged along two axes X, Y which are perpendicular to each other.

A final container reception zone 2 can also be seen which defines a matrix of individual reception zones for final containers which each receive an individual final container 71, 71', 71". In accordance with the defined matrix, the individual final containers 71, 71', 71" are arranged along two axes X, Y which are perpendicular to each other.

FIG. 2 also shows diagrammatically a transfer circuit which comprises a set 3 of devices for extracting a substance from an individual initial container, 31, 32, 33 which are in a linear arrangement, so that they form a vector of devices parallel, in this case, to the Y axis. In this case, each of the devices for extracting a substance from an individual initial container 31, 32, 33 is connected to a flexible tube 9, 9', 9", each of which connects with a device 41, 42, 43 for introducing a substance into the final containers 71, 71', 71". The transfer is performed by means of the respective peristaltic pumps 51, 52, 53.

The substance introduction devices 41, 42, 43 are in a linear arrangement, so as to form a vector of devices parallel, in this case, to the Y axis. The substance introduction devices 41, 42, 43 form a set 4 of introduction devices.

In the machine shown, the initial container reception zone 1 and the set 3 of extraction devices have the ability to move relative to the length of the axis Q, which is parallel to the axis X, and perpendicular to the axis Y, parallel to which the vector formed by the extraction devices 31, 32, 33 extends.

In addition, in the machine shown the final container reception zone 2 and the set 4 of extraction devices have the ability to move relative to the length of the axis Q, which is parallel to the axis X, and perpendicular to the axis Y, parallel to which the vector formed by the extraction devices 41, 42, 43 extends.

FIGS. 3 to 10 show an embodiment of a machine according to the present invention. In FIGS. 1 and 2, equivalent or functionally similar elements have been designated with identical numerals, and said elements will therefore not be described in detail.

The machine shown in FIGS. 3 to 10 is a semiautomatic machine for preparing intravenous mixtures. The machine in the example is made up of two differentiated portions, the traceability zone 200 and the preparation zone 300.

The traceability zone 200 is the zone where in a controlled manner the user loads and unloads the material to be used.

The preparation zone 300 is the zone where the automatic dispensing of doses of products from the initial containers to the final containers is performed.

In the machine configuration shown in the figures, the machine depth may be 600 mm, for example. These dimensions allow trays to be fitted defining a matrix of 7×3 elements, as shown in FIGS. 3 to 10. Of course, smaller dimensions are possible, such as 4×3 elements or 2×3 elements, for example. When reducing (or increasing) the size of the machine, consideration must be given to need for the space for the peristaltic pumps and the traceability zone to be redistributed compared with that shown in the figures.

The machine is capable of preparing various products in different containers, such as syringes with Luer-Loks, infusion bags of different capacities and from different suppliers, vials, infusers or cassettes having different volumes and/or bottles.

To be able to fill syringes, infusers and cassettes it is useful to have a machine with addition points such as those shown diagrammatically in FIG. 1. In this case, it would be possible to fit a female-female Luer-Lok connector in order to connect the addition point to the syringes.

To be able to dispense doses using peristaltic pumps 51, 52, 53, flexible tubes, preferably made of silicone, have to be used. At each end, the tubes can have different accessories, such as needles, tube-male Luer-Lok connectors, and 90° tube-tube (Ls) connectors if this type of connector proves necessary at the inlet and outlet of the peristaltic pumps.

Figure 3:
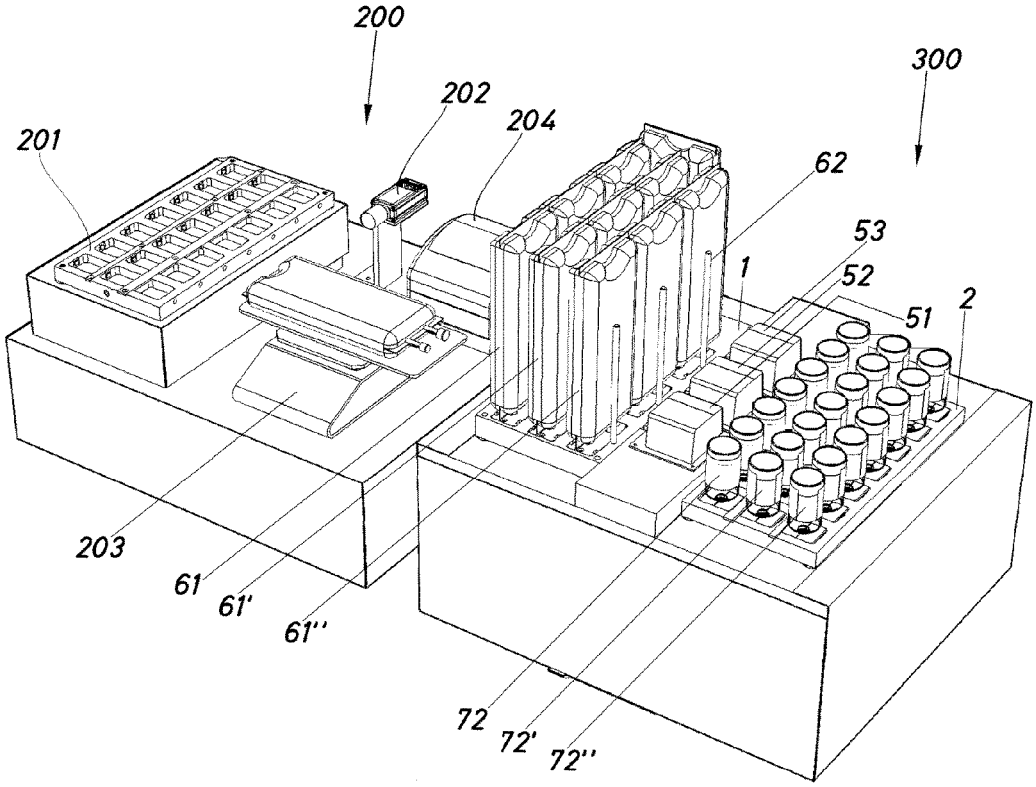
FIG. 3 is a perspective view of an embodiment of a machine according to the present invention.
Figure 4:
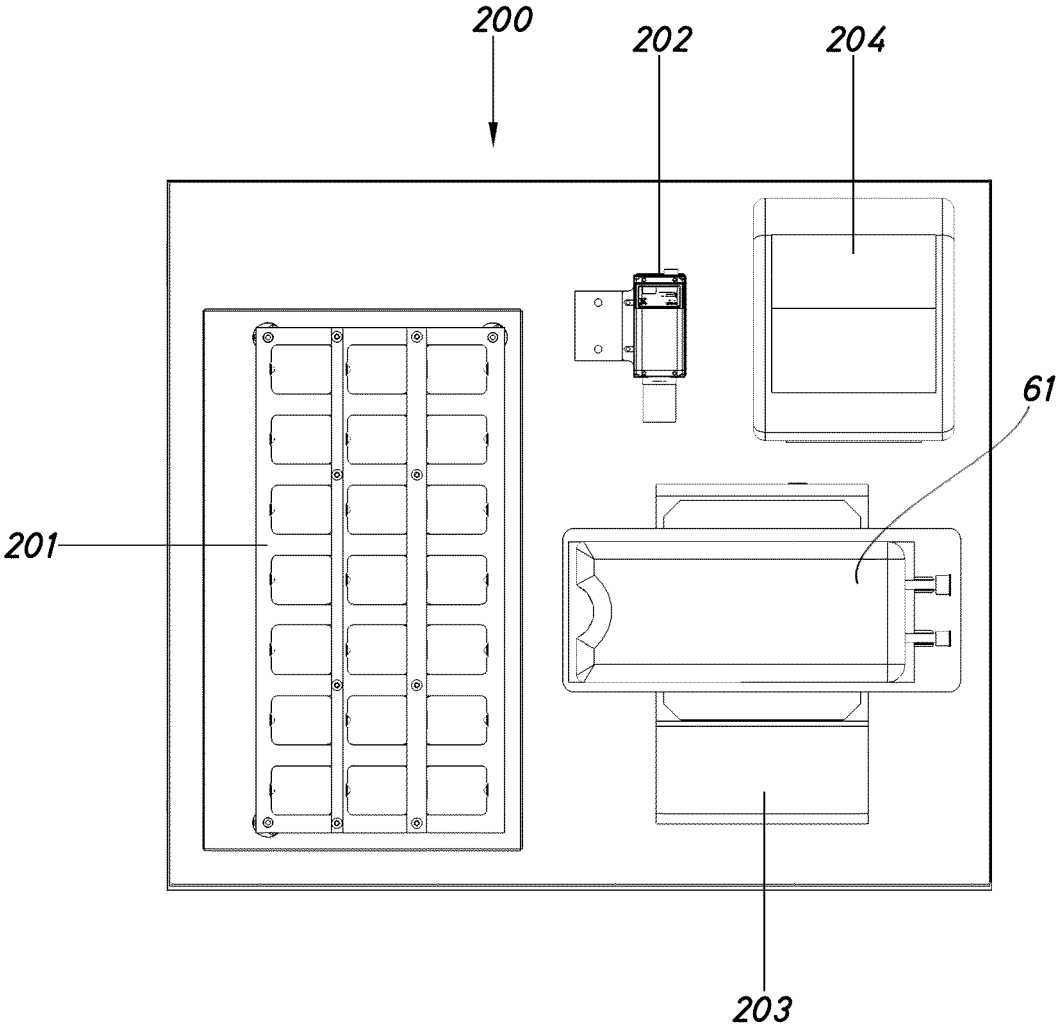
FIG. 4 is a view from above of the preparation zone of the machine of FIG. 3.
Figure 5:
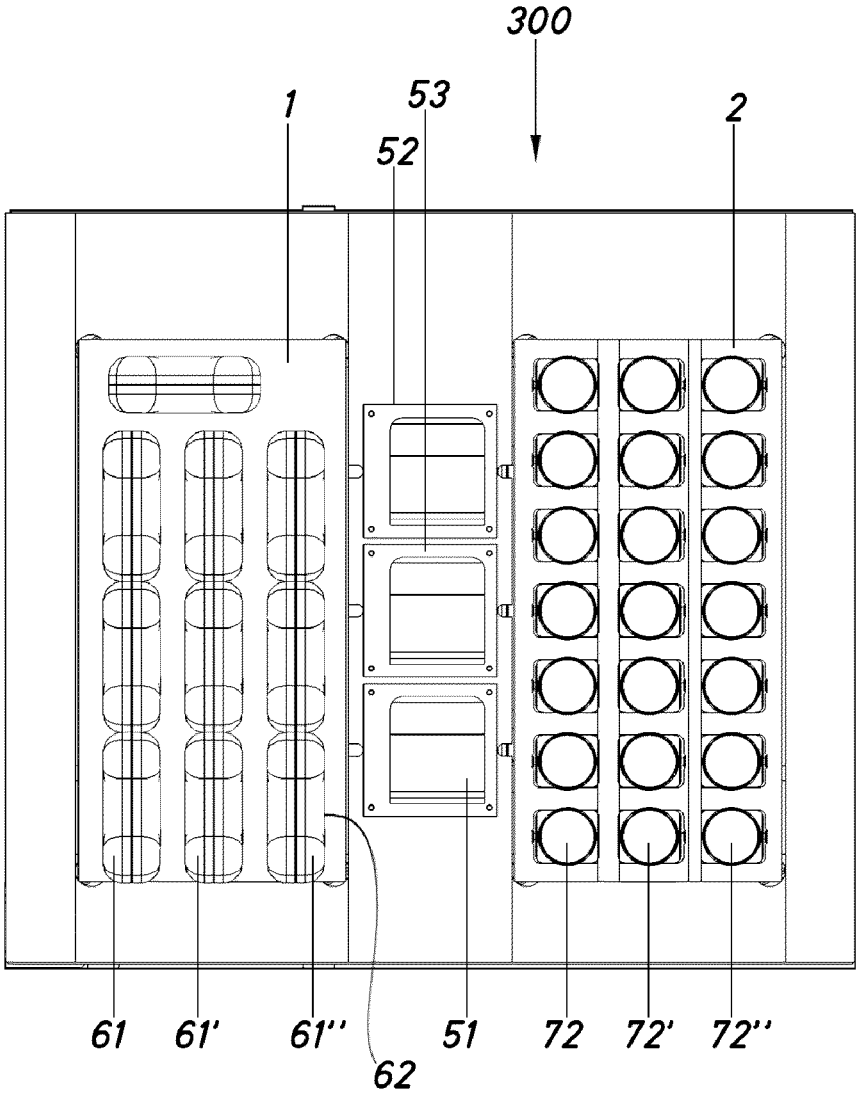
FIG. 5 is a view from above of the work zone of the machine of FIG. 3.

The traceability zone 200 can be seen in FIGS. 3 and 4. This portion of the machine can be lower than the preparation zone 300, so that loading the vials and the end products into the trays is more ergonomic.

Within the traceability zone 200 illustrated, the following peripheral elements are located:

- Code reader 202, for example a bar code reader, RFID tag reader, etc.
- Printer 204 for the double labelling of the end products, before and after preparation. The end product label can be printed by reading the datamatrix code from the code reader 202 and thus applying the label to the appropriate end product or vial.
- Scales 203 for weighing each product before and after preparation. This ensures that the dosing process is accurate and precise. The scales 203 may have a tray, which is used to weigh the infusion bags 61 correctly, as seen in FIG. 3. Weighing can be performed product by product or all together, depending on whether the dose dispensing to be performed is critical or not.

The machine shown can also have a user interface, for example, with a screen, keyboard and/or buttons, etc. (not shown in the figures).

Materials are prepared in the traceability zone 200, being placed on trays 201 designed for the purpose. All the types of trays, both those for the initial containers and those for the final containers, are placed in the same zone 200. By positioning them correctly, controlled and safe loading of the material can be carried out. FIGS. 3 to 8 show a traceability zone for transferring a substance between vials and bags, which can take place in either direction, regardless. In particular, the initial containers 61, 61', 61" considered to be bags in the explanation that follows, whereas the final containers 71, 71', 71" are vials. Because it is reversible, this machine can also be used where the initial containers are vials and the final containers are bags.

To perform the processes described, the traceability zone 200 may have lights and inductive detectors for detecting the containers that have been positioned (not shown in the figures).

The trays 201 can be designed so that they can only be placed in one position, for example by "poka-yoke" (mistake-proofing) devices and detectors, or by means of RFID readers and RFIDs on each tray, which when detected turn on different coloured pilot lights, red and green, for example (not shown in the figures), which may be LED lights. The pilot lights can also be used to guide the user and avoid errors.

When loading a tray 201 with vials, the following steps can be followed:

Placing the tray 201 in the correct position,

Checking on the screen that it is the correct tray,

Reading the bar code on a vial,

Showing a green light (LED) in the position on the tray where the vial should be placed (the LEDs have not been shown in the figures).

Positioning the vial in the vial tray 201.

Detecting the presence of a vial.

Turning off the light that was lit previously.

For loading bags or syringes (in general any type of final container), the process is different:

Taking the adapted appropriate tray for the end product (syringes, bags, etc.),

Placing the tray in the correct position,

Checking on screen that it is the correct tray,

Reading the bar code, if applicable,

Weighing,

Printing and sticking the pre-label (if required),

Showing a light in the position in the tray where it should be placed,

Placing it in the appropriate tray and in the correct position,

Detecting the container,

Turning off the light.

For unloading, the opposite processes are carried out.

Once they have been prepared, the products will be weighed and labelled again. This allows accuracy to be controlled.

In the example shown, the different containers are placed initially in trays which are then placed in the corresponding reception zones. The use of trays ensures that the position of the injection points for the substance transfer operations is correct for whatever type of container is used.

However, it is necessary to insert the needle to a different level in vials, syringes and infusers. The use of trays for each type of container ensures that the distance of vertical movement of the needle of the extraction device or introduction device is the same for all types of containers.

The preparation zone 300 where the substance is transferred between containers can be seen in FIG. 3 and FIG. 5 to 10.

The preparation zone 300 is made up of various different elements. These are two reception zones for the initial containers and for the final containers 1, 2 in which the trays are positioned, one for the initial containers and the other for the final containers. Three vertical axes are situated beneath each zone (see, FIG. 6) forming, respectively, the extraction devices and introduction devices 31, 32, 33, 41, 42, 43. Puncturing accessories, such as needles 44, 45, 46 for example (see, FIG. 8 and FIG. 9) are positioned in said devices, the function of which is to penetrate the different initial containers 61, 61', 61" (bags) and final containers 71, 71', 71" (vials) for the extraction/introduction of liquid.

For extracting liquid from the initial containers and dispensing a dose into the final containers, in this case three independent peristaltic pumps 51, 52, 53 (see, FIGS. 3 and 5) are provided, positioned in the central portion of the preparation zone 300.

The extraction devices and introduction devices 31, 32, 33, 41, 42, 43 (see, FIGS. 6 and 9) are positioned in a linear arrangement on two horizontal conveyors, one for each set 3, 4 of independent devices. Three final containers can therefore be filled at the same time.

Figure 6:
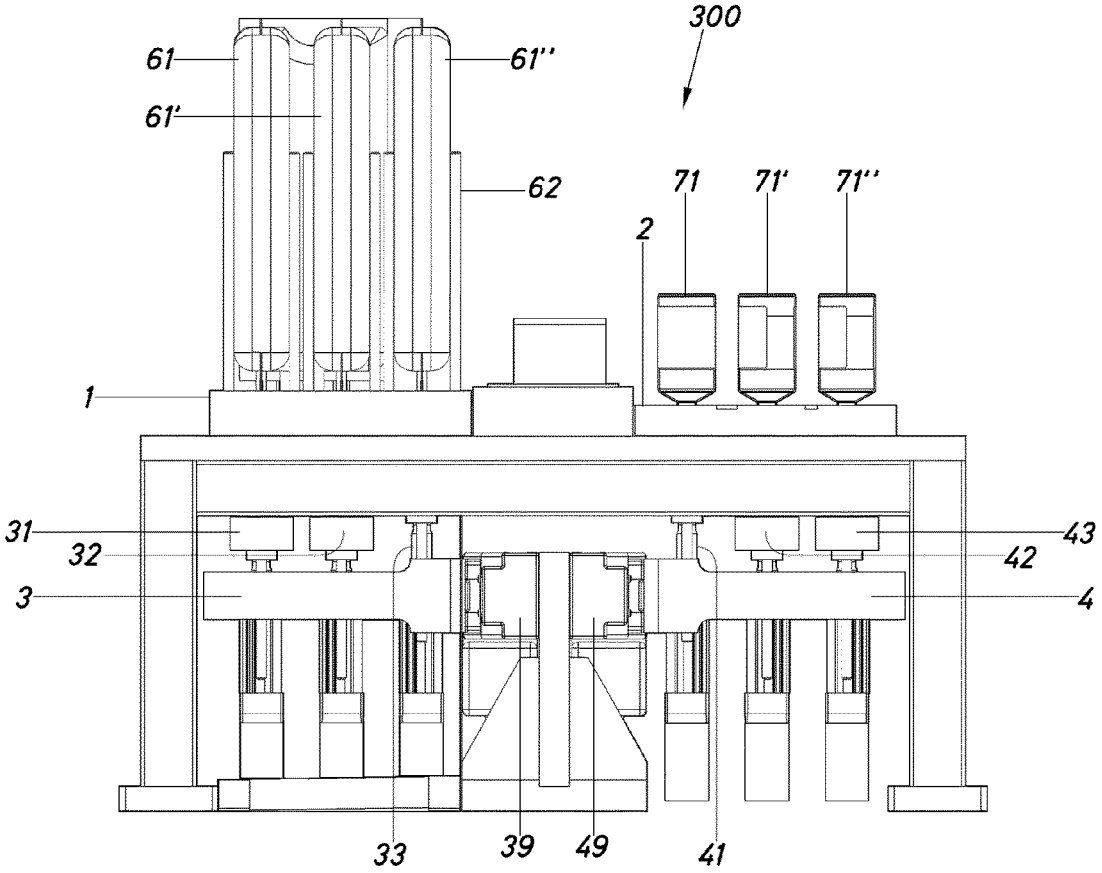
FIG. 6 is a view in front elevation of the machine of FIG. 3, with the lower casing removed so that the internal elements can be seen.
Figure 7:
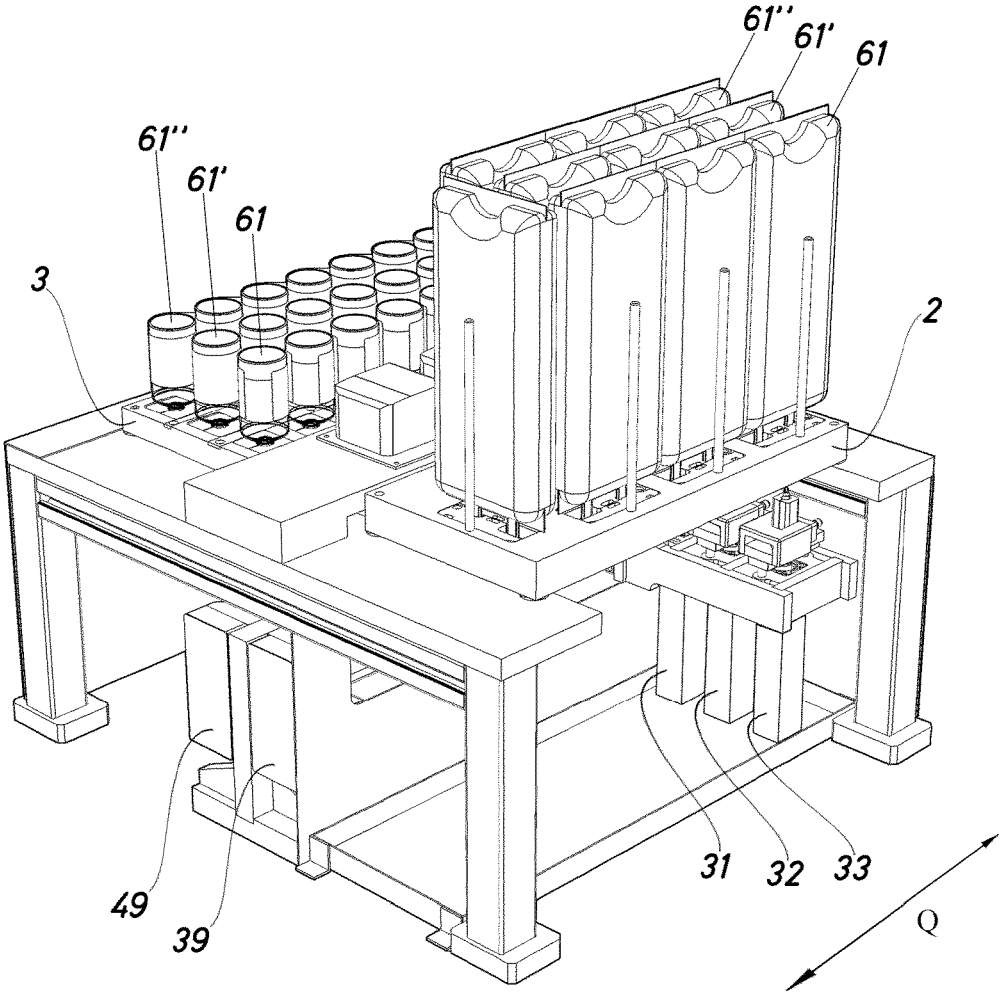
FIG. 7 is a perspective view of the machine of FIG. 6.
Figure 8:
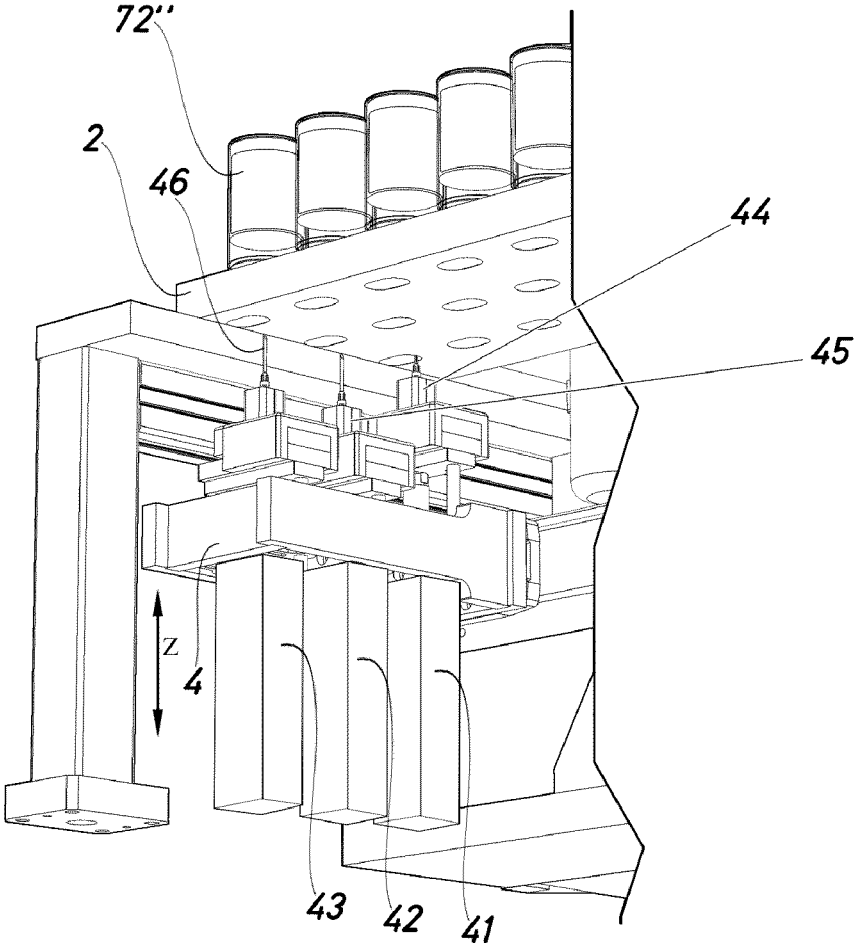
FIG. 8 is a perspective view, from another point of view, of a detail of the introduction devices.
Figure 9:
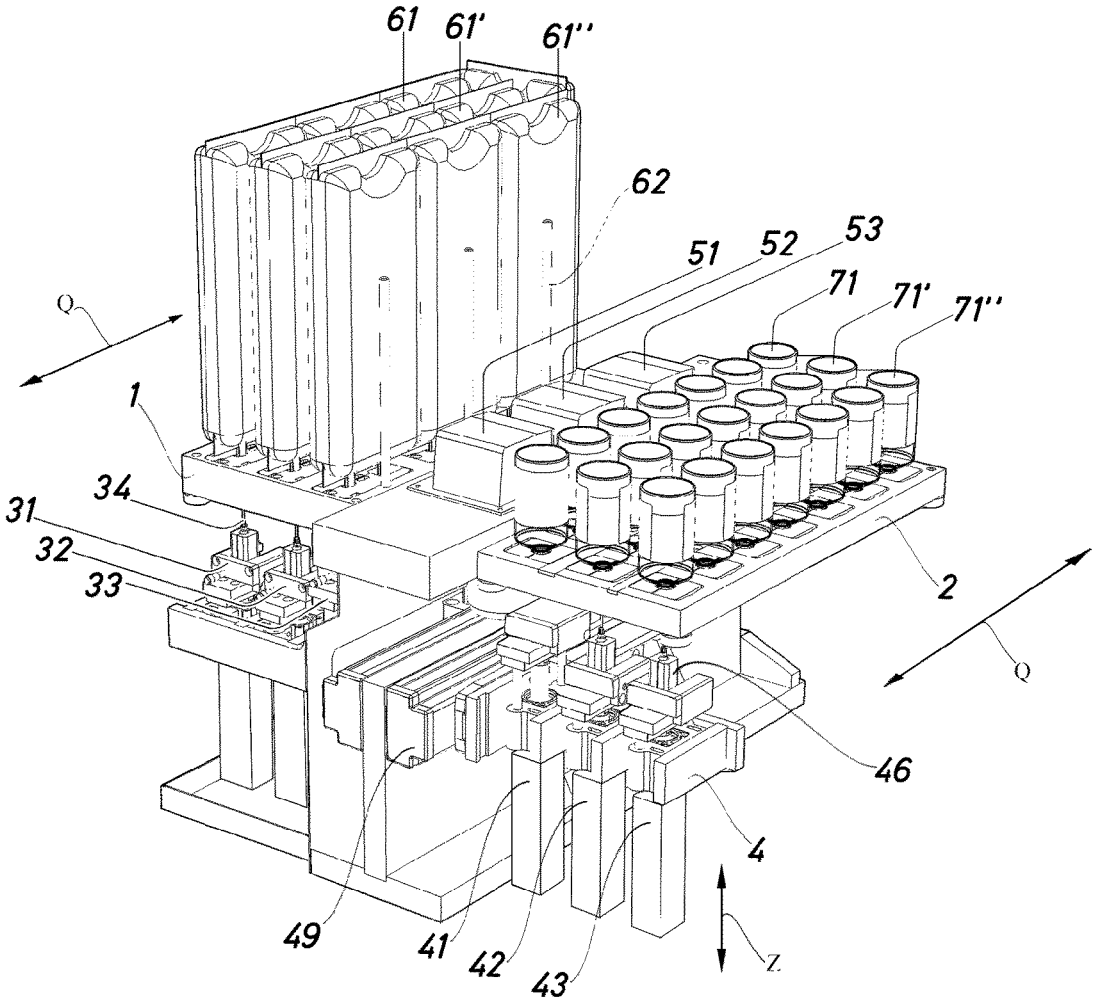
FIG. 9 is another perspective view similar to that of FIG. 7 with some elements removed in order to observe more internal elements.
Figure 10:
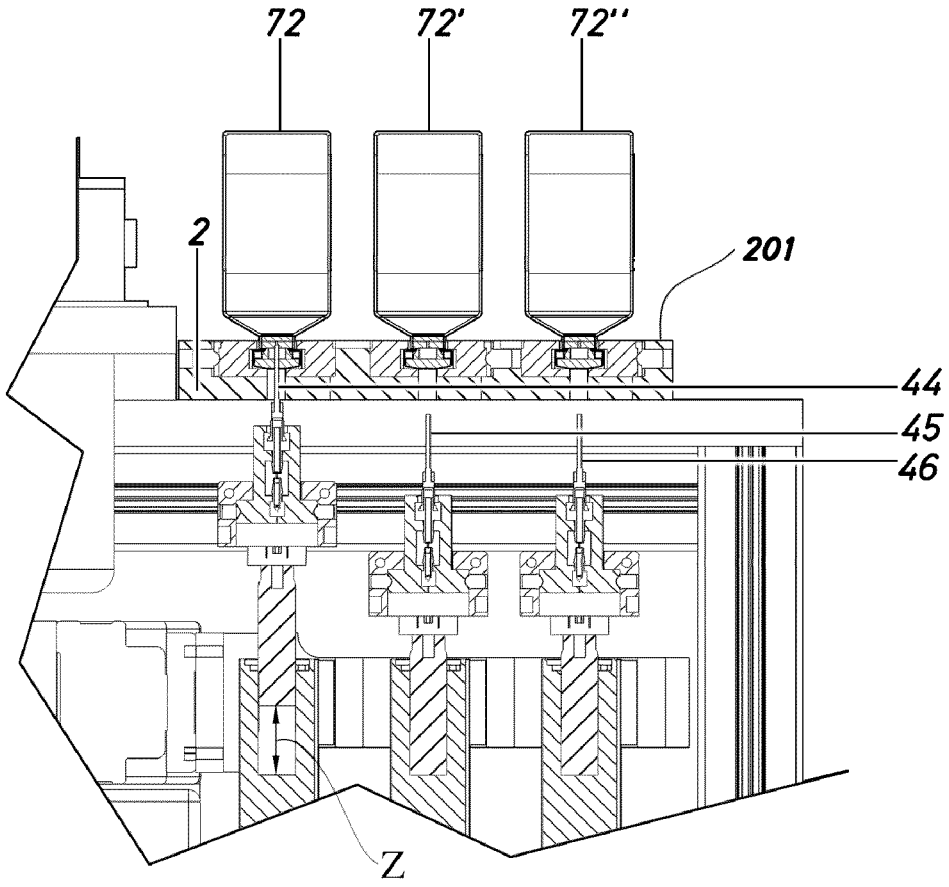
FIG. 10 is a view in cross section of a detail of the introduction devices.

Each horizontal conveyor can move along the corresponding horizontal guide 39, 49 (see FIG. 6).

At the same time, each extraction device or introduction device 31, 32, 33, 41, 42, 43 has its own independent vertical actuation cylinder (direction Z in FIG. 9), so that all the needles 34, 44, 45, 46 can be raised independently. It is therefore possible to fill any type of final container simply by changing the tray.

A fluid (or bubble) detector can be positioned at the outlet of the peristaltic pumps 51, 52, 53 to prevent inaccurate filling (not shown in the figures).

Trays

The system for fitting the trays in the material preparation zone 300 will be similar to that for the traceability zone.

The trays may have mistake-proofing devices (such as a notch in a corner of the tray, etc.) to ensure that it is only possible to position the trays in the zone where the initial containers and the final containers should be positioned, in the appropriate orientation. The tray of bags has separators 62 for holding the trays in a vertical arrangement and separate from each other.

However, as in the loading zone, there are various ways of differentiating between the types of trays without losing process traceability, for example:

Having an RFID reader and an RFID in each tray,

Having mistake-proofing devices and detectors,

Providing a camera.

Compared with other known machines, the machine of the example has a higher production rate, greater security, high capacity, because of the peristaltic pumps, is easy to clean, is smaller and lighter and is user friendly as well as being ergonomic, since its working height allows it to be placed in a laminar flow cabinet without the need to incorporate a system for generating an aseptic atmosphere in the machine, for example.

Although the invention have been described with reference to preferred embodiments, these should not be considered as limiting the invention, which will be defined by the widest interpretation of the following claims.

What is claimed is:

1. A machine for preparing substances for intravenous application which comprises:

an initial container reception zone, which defines a matrix of individual initial container reception zones, comprising individual initial containers arranged along two horizontal axes which are perpendicular to each other, a final container reception zone, which defines a matrix of individual final container reception zones, comprising detached individual final containers arranged along two horizontal axes which are perpendicular to each other, a substance transfer circuit which comprises a set of independent devices for extracting a substance from each individual initial container, said extraction devices being in a linear arrangement, so as to form a vector of extraction devices parallel to one of said axes of the matrix of individual initial container reception zones, each one being connected to a flexible tube connected to a device for introducing a substance into the respective final container, by means of an independent pump, the substance introduction devices also being in a linear arrangement to each other, so as to form a vector of introduction devices, and in which the initial container reception zone or the vector of extraction devices or both are capable of relative movement along a horizontal axis perpendicular to the vector of extraction devices, and/or the final container reception zone and the vector of introduction devices are capable of relative movement along a horizontal axis perpendicular to the vector of introduction devices wherein each of the introduction devices and the extraction devices are configured to move vertically by its own independent vertical actuation cylinder, so that the introduction devices and the extraction devices connect to and disconnect from the respective containers, and each of the introduction or extraction devices is configured to move vertically independently of the rest of the devices in its vector.

2. The machine according to claim 1, wherein the initial container reception zone and the vector of extraction devices have said ability to move relative to one another and in addition the final container reception zone and the vector of introduction devices also have said ability to move relative to one another.

3. The machine according to claim 1, wherein the introduction and/or extraction devices have addition points.

4. The machine according to claim 1, wherein the introduction devices and/or extraction devices comprise syringes.

5. The machine according to claim 1, wherein said vector of introduction devices is parallel to one of said axes of the matrix in which the final container reception zones are arranged.

6. The machine according to claim 1, wherein said pump or pumps is/are peristaltic pump/s.

7. A method for preparing substances for intravenous application, comprising:

arranging individual initial containers along at least two horizontal axes which are perpendicular to each other in an initial container reception zone, which defines a matrix of individual initial container reception zones, arranging detached individual final containers along two horizontal axes which are perpendicular to each other in a final container reception zone, which defines a matrix of individual initial container reception zones, extracting a substance from each individual initial container from a substance transfer circuit comprising a vector of extraction devices parallel to one of said axes of the matrix in linear arrangement, introducing a substance into each of final containers by pumping the substance from an introduction device through a flexible tube from a plurality of introduction devices which are in a linear arrangement to each other, so as to form a vector of introduction devices, and moving either or both of the initial container reception zone or the vector of extraction devices along a horizontal axis perpendicular to the vector of extraction devices, or moving either or both of the final container reception zone and the vector of introduction devices along a horizontal axis perpendicular to the vector of introduction devices, wherein the introduction devices and the extraction devices are moved vertically, so that they can connect to / disconnect from the respective containers, and each of the introduction or extraction devices is moved vertically independently of the rest of the devices in its vector.

8. The method according to claim 7, wherein the initial container reception zone and the vector of extraction devices are moved relative to one another and in addition the final container reception zone and the vector of introduction devices are moved relative to one another.

9. The method according to claim 7, wherein the vector of the introduction devices is parallel to one of said axes of the matrix in which the final container reception zones are arranged.

* * * * *